US011732974B2

(12) United States Patent
Hsieh

(10) Patent No.: US 11,732,974 B2
(45) Date of Patent: Aug. 22, 2023

(54) THIN-TYPE TWO-PHASE FLUID DEVICE

(71) Applicant: ASIA VITAL COMPONENTS CO., LTD., New Taipei (TW)

(72) Inventor: Kuo-Chun Hsieh, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 0 days.

(21) Appl. No.: 17/142,244

(22) Filed: Jan. 6, 2021

(65) Prior Publication Data

US 2022/0214117 A1 Jul. 7, 2022

(51) Int. Cl.
*F28D 15/04* (2006.01)

(52) U.S. Cl.
CPC ..... *F28D 15/04* (2013.01)

(58) Field of Classification Search
CPC ..... F28D 15/40; F28D 15/406; H05K 7/2029; H05K 7/20336; H01L 23/427
USPC ..... 165/104.26
See application file for complete search history.

(56) References Cited

U.S. PATENT DOCUMENTS

| | | | | |
|---|---|---|---|---|
| 8,215,377 | B1 | 7/2012 | Monson et al. | |
| 2007/0077165 | A1* | 4/2007 | Hou | B22F 1/0003 75/255 |
| 2010/0294467 | A1* | 11/2010 | Varanasi | F28D 15/046 427/470 |
| 2010/0294475 | A1* | 11/2010 | Rush | H01L 23/427 165/185 |
| 2020/0080792 | A1* | 3/2020 | Hirono | F24D 10/00 |
| 2020/0100390 | A1* | 3/2020 | Koo | H04M 1/026 |
| 2020/0158445 | A1* | 5/2020 | Shin | F28D 15/02 |
| 2021/0262737 | A1* | 8/2021 | North | F28D 15/046 |

FOREIGN PATENT DOCUMENTS

| | | | |
|---|---|---|---|
| CN | 1707783 | A | 12/2005 |
| CN | 1725478 | A | 1/2006 |
| CN | 103105084 | A | 5/2013 |
| CN | 103185476 | A | 7/2013 |
| CN | 104976909 | A | 10/2015 |

(Continued)

OTHER PUBLICATIONS

Search Report dated Jan. 19, 2022 issued by Taiwan Intellectual Property Office for counterpart application No. 109142209.

(Continued)

*Primary Examiner* — Tho V Duong
(74) *Attorney, Agent, or Firm* — Demian K. Jackson; Jackson IPG PLLC

(57) ABSTRACT

A thin-type two-phase fluid device includes a first plate body, a second plate body and a polymer layer. The first plate body has a first face, a second face and multiple bosses. The bosses are disposed on the first face and raised therefrom. The second plate body has a nanometer capillary layer on one face. The nanometer capillary layer is formed from a mixture of multiple kinds of powders with different sizes. The nanometer capillary layer is attached to a surface of the second plate body opposite to the first face of the first plate body. The polymer layer is selectively connected with the first plate body or the second plate body. The total thickness of the thin-type two-phase fluid device is equal to or smaller than 0.25 mm, whereby the object of thinning the heat dissipation device is achieved.

4 Claims, 4 Drawing Sheets

(56) References Cited

FOREIGN PATENT DOCUMENTS

| | | | |
|---|---|---|---|
| CN | 105865241 | A | 8/2016 |
| CN | 108871026 | A | 11/2018 |
| CN | 109874270 | A | 6/2019 |
| CN | 111761049 | A | 10/2020 |
| CN | 111811305 | A | 10/2020 |
| CN | 214666254 | U | 11/2021 |
| TW | M610814 | U | 4/2021 |

OTHER PUBLICATIONS

NPL: Advanced Materials for Thermal Management of Electronic Packaging (pp. 278-279).
Search Report dated Apr. 24, 2022 issued by China National Intellectual Property Administration for counterpart application No. 2020113830947.

* cited by examiner

THIN-TYPE TWO-PHASE FLUID DEVICE

BACKGROUND OF THE INVENTION

1. Field of the Invention

The present invention relates generally to a thin-type two-phase fluid device, and more particularly to a thinned two-phase fluid device.

2. Description of the Related Art

In order to achieve better heat transfer effect, in the heat dissipation field, the heat dissipation device employing two-phase fluid heat exchange principle is used as the heat transfer component. In the heat dissipation devices, the vapor chamber and heat pipe are most often used. The vapor chamber and the heat pipe employ two-phase fluid heat exchange principle so that the main structures of the vapor chamber and the heat pipe must be made of a material with better heat conductivity, wherein copper is the most often seen material. The main body must have an internal vacuumed airtight chamber. Also, capillary structure is disposed on the wall face of the chamber and a working liquid is filled in the chamber. In the vacuumed environment, the boiling point of the working liquid is lowered and two-phase fluid (vapor and liquid) circulation can be carried out in the vacuumed airtight chamber to achieve better heat transfer efficiency.

A conventional vapor chamber has a main body composed of at least one plate body equipped with capillary structure and another plate body mated with the at least one plate body. Then the periphery of the main body is sealed and water (liquid working fluid) is filled into the chamber and the chamber is vacuumed to form the vapor chamber. The capillary structure in the vapor chamber mainly serves to make the liquid working fluid flow from the condensation section back to the evaporation section and store the liquid working fluid in the evaporation section. The capillary structure generally has the form of a sintered body, a mesh body, a fiber body and a channeled body, which is a structure capable of providing capillary attraction.

The sintered body is formed in such a manner that one face of the plate body is coated with metal powders. The metal powders are sintered and attached to the plate body to form a porous capillary structure. In the sintering process, each two adjacent powders are heated to a semi-molten state, whereby the powders are bonded with each other to form the porous capillary structure. In order to keep the capillary structure of the sintered powders with the property of porosity, the size of the sintered powders is limited. In the case that the size of the sintered powders is too small, after semi-molten, the sintered powders will nearly have no void therebetween. Under such circumstance, the sintered powders cannot form the porous capillary structure. That is, the capillary structure cannot provide any capillary attraction. Therefore, those fine sintered powders with too small size cannot be selectively used for the existing sintered body. Only those sintered powders with proper size can be sintered to form the capillary structure with voids between the powders to achieve capillary attraction. However, in this case, the sintered structure will be thickened. As a result, the conventional sintered body cannot be applied to an extremely thinned vapor chamber structure. Moreover, the current vapor chamber employing sintered body cannot be folded (bent) or flexed. This is because after the vapor chamber is folded (bent), the sintered body in the chamber will be broken and destroyed to detach. This will lead to failure of the capillary structure on the plate body to lose the heat spreading and dissipation function.

Therefore, in order to solve the problem that the conventional sintered body cannot be applied to an extremely thinned vapor chamber structure, the manufacturers try to use the channeled structure with poorer capillary attraction or a mesh body or a woven mesh with capillary attraction smaller than the sintered powders as the capillary structure. The mesh body or the woven mesh can be conveniently arranged and applied to those parts, which need to be bent. However, when disposing the mesh body or the woven mesh in the vapor chamber, the mesh body or the woven mesh must be fully attached to the wall of the case or the pipe so that the mesh body or the woven mesh can provide capillary attraction for spreading the working liquid. In the case that the mesh body or the woven mesh fails to fully attach to or be laid on the surface of the wall of the case or the pipe, gaps exist therebetween so that no capillary attraction is provided for the working liquid to spread and carry out vapor-liquid circulation. Also, the mesh body and the woven mesh are mainly composed of multiple filament-shaped monomers, which intersect each other or which are woven with each other. Due to the limitation of the current processing machine and material, the diameter of each filament-shaped monomer (such as filament-shaped metal wire) can be hardly further minified. Therefore, the total thickness of the mesh body (or woven mesh) formed of the multiple filament-shaped monomers, which intersect each other or which are woven with each other cannot be further reduced. As a result, the conventional mesh body and woven mesh also cannot be applied to the extremely thinned vapor chamber structure.

Therefore, the manufacturers can only settle for the second best to employ the channeled structure with poorer capillary attraction. The channeled structure is formed in such a manner that the wall face of the case of the vapor chamber is mechanically processed to form the channeled structure as the capillary structure. However, this leads to another problem that when the wall face of the case of the vapor chamber is formed with the channeled structure, the wall of the case of the vapor chamber is also thinned. This will affect the structural strength of the entire vapor chamber so that it often takes place that the wall of the case of the vapor chamber is broken. In this case, the working liquid will leak out to lose the heat spreading and dissipation effect. When the wall face of the case of the vapor chamber is formed with the channeled structure, the wall of the case of the vapor chamber is thinned to weaken the structural strength of the entire vapor chamber. In the case that the vapor chamber is bent or curled, the section formed with the channeled structure is apt to break off. In consideration of the above problems, the manufacturers often quit using the channeled structure on the extremely thin wall of the case of the heat pipe or vapor chamber as the capillary structure.

Therefore, under the trend toward extremely thin vapor chamber, the total thickness of the vapor chamber is quite limited. The thickness of the wall of the case of the vapor chamber is limited to an extremely thin specification. Also, the internal airtight chamber and the capillary structure of the vapor chamber must be further minified. It can be known from the above that when designing the extremely thin vapor chamber, it is critical how to select and manufacture the capillary structure.

It is therefore tried by the applicant to provide a thin-type two-phase fluid device to solve the above problems existing in the conventional extremely thin vapor chamber. The thin-type two-phase fluid device can provide capillary attraction and is bendable and flexible.

SUMMARY OF THE INVENTION

It is therefore a primary object of the present invention to provide a thin-type two-phase fluid device, which is bendable and applicable to extremely thin vapor chamber.

To achieve the above and other objects, the thin-type two-phase fluid device of the present invention includes a first plate body, a second plate body and a polymer layer.

The first plate body has a first face, a second face and multiple bosses. The bosses are disposed on the first face and raised therefrom. The second plate body has a nanometer capillary layer on one face. The nanometer capillary layer is formed from a mixture of multiple kinds of powders with different sizes. The nanometer capillary layer is attached to a surface of the second plate body opposite to the first face of the first plate body. The polymer layer is selectively connected with the first plate body or the second plate body. The total thickness of the first plate body, the second plate body and the polymer layer is equal to or smaller than 0.25 mm.

The thin-type two-phase fluid device of the present invention is bendable and applicable to extremely thin heat dissipation device. Also, the thin-type two-phase fluid device of the present invention can keep the capillary attraction of the internal capillary structure to solve the problems existing in the conventional extremely thin heat dissipation device.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
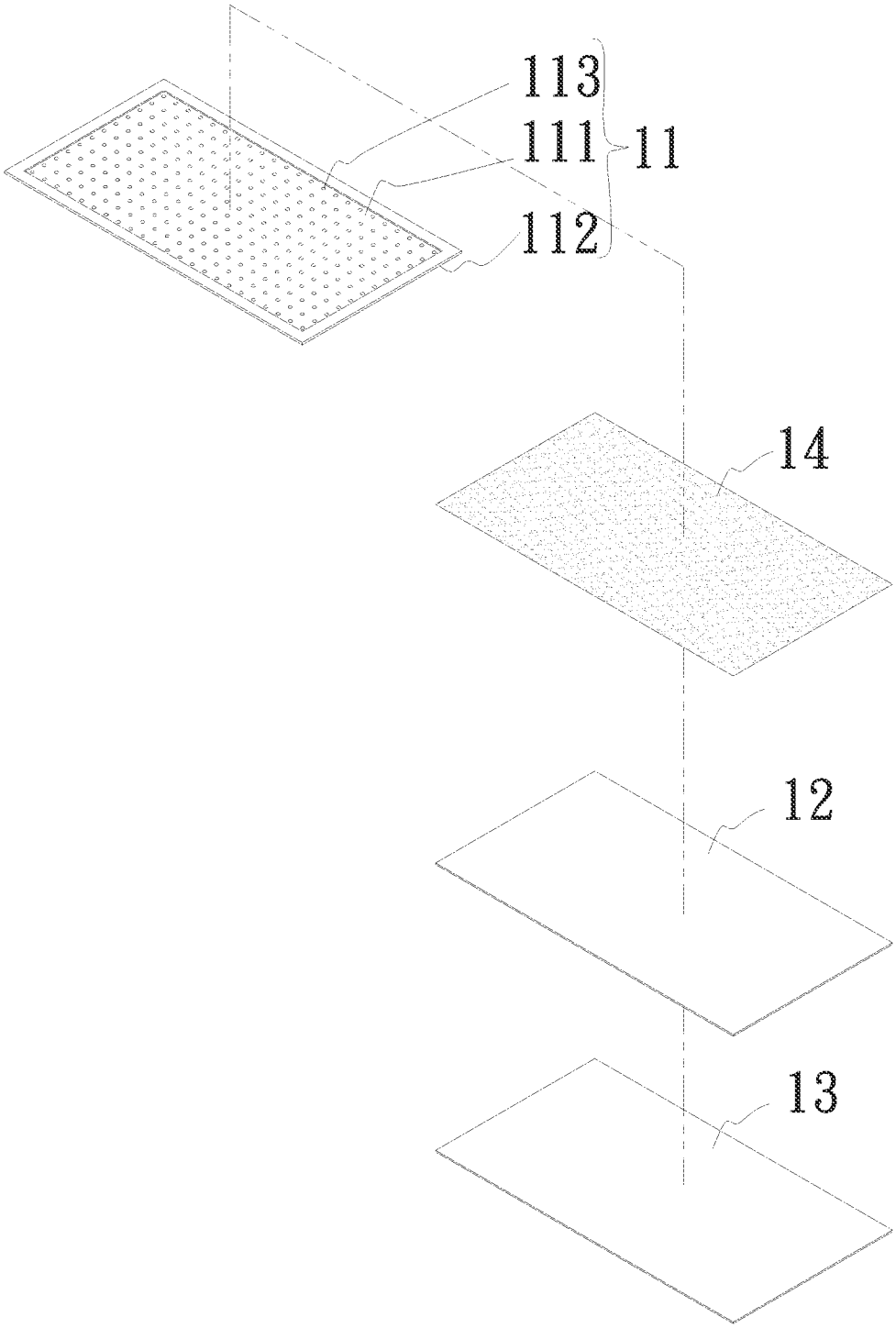
FIG. 1 is a perspective exploded view of a first embodiment of the thin-type two-phase fluid device of the present invention.
Figure 2:
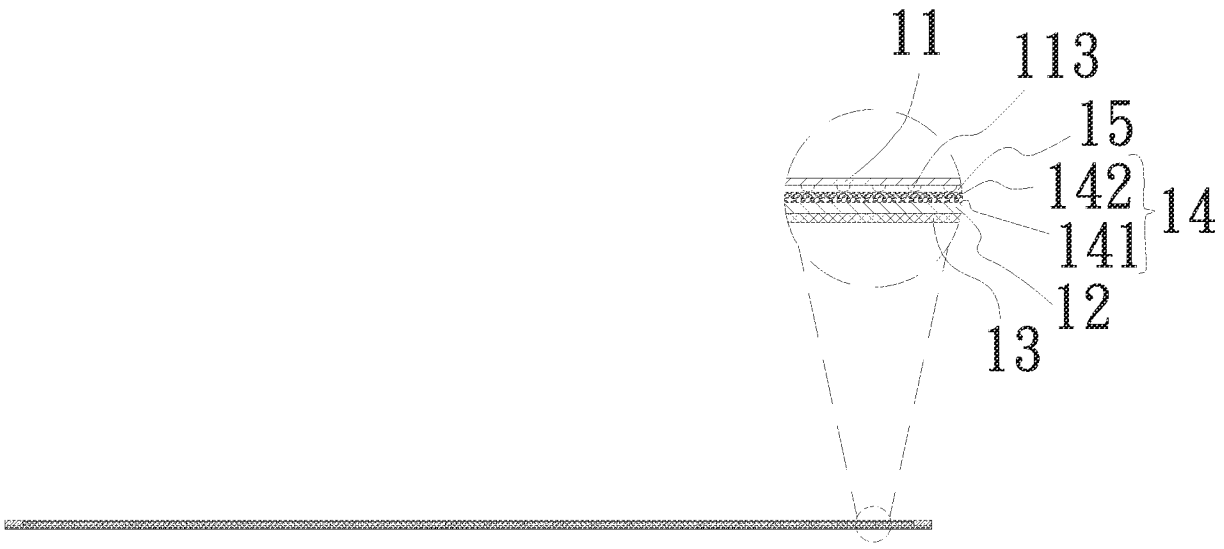
FIG. 2 is a sectional assembled view of the first embodiment of the thin-type two-phase fluid device of the present invention.

Please refer to FIGS. 1 and 2. FIG. 1 is a perspective exploded view of a first embodiment of the thin-type two-phase fluid device of the present invention. FIG. 2 is a sectional assembled view of the first embodiment of the thin-type two-phase fluid device of the present invention. The thin-type two-phase fluid device 1 of the present invention includes a first plate body 11, a second plate body 12 and a polymer layer 13.

The first plate body 11 has a first face 111, a second face 112 and multiple bosses 113. The bosses 113 are disposed on the first face 111 and raised therefrom. The second plate body 12 has a nanometer capillary layer 14 on one face. The nanometer capillary layer 14 is formed from a mixture of multiple kinds of powders with different sizes. The nanometer capillary layer 14 is attached to a surface of the second plate body 12 opposite to the first face 111 of the first plate body 11. The first and second plate bodies 11, 12 are overlapped and mated with each other to define an airtight chamber 15. The nanometer capillary layer 14 is disposed in the airtight chamber 15. A working liquid (not shown) is filled in the airtight chamber 15.

The polymer layer 13 is selectively connected with the first plate body 11 or the second plate body 12. The total thickness of the thin-type two-phase fluid device 1 is equal to or smaller than 0.25 mm.

The polymer layer 13 is selectively connected with the surface of the first plate body 11 or the second plate body 12 by means of painting or printing or adhesion.

In this embodiment, the heat dissipation device is, but not limited to, a vapor chamber for illustration. Alternatively, the heat dissipation device can be a thin-type flat-plate heat pipe. The first and second plate bodies 11, 12 is made of a material selected from a group consisting of copper, aluminum, stainless steel and commercial pure titanium. The thickness of the first and second plate bodies 11, 12 is approximately 0.1 mm.

The nanometer capillary layer 14 has multiple first powders 141 and multiple second powders 142. The diameter of the first powders 141 is larger than the diameter of the second powders 142. The first and second powders 141, 142 are mixed and formed on one face of the second plate body 12 opposite to the first plate body 11 by means of sintering, adhesion, spraying or printing. Alternatively, multiple kinds of powders with different sizes are adhered to each other by means of an adhesive (liquid phase or solid phase) and painted on the surface of the second plate body 12. After the liquid-phase adhesive is air-dried, the multiple kinds of powders with different sizes are attached to the surface of the second plate body 12 to form the nanometer capillary layer 14.

Figure 3:
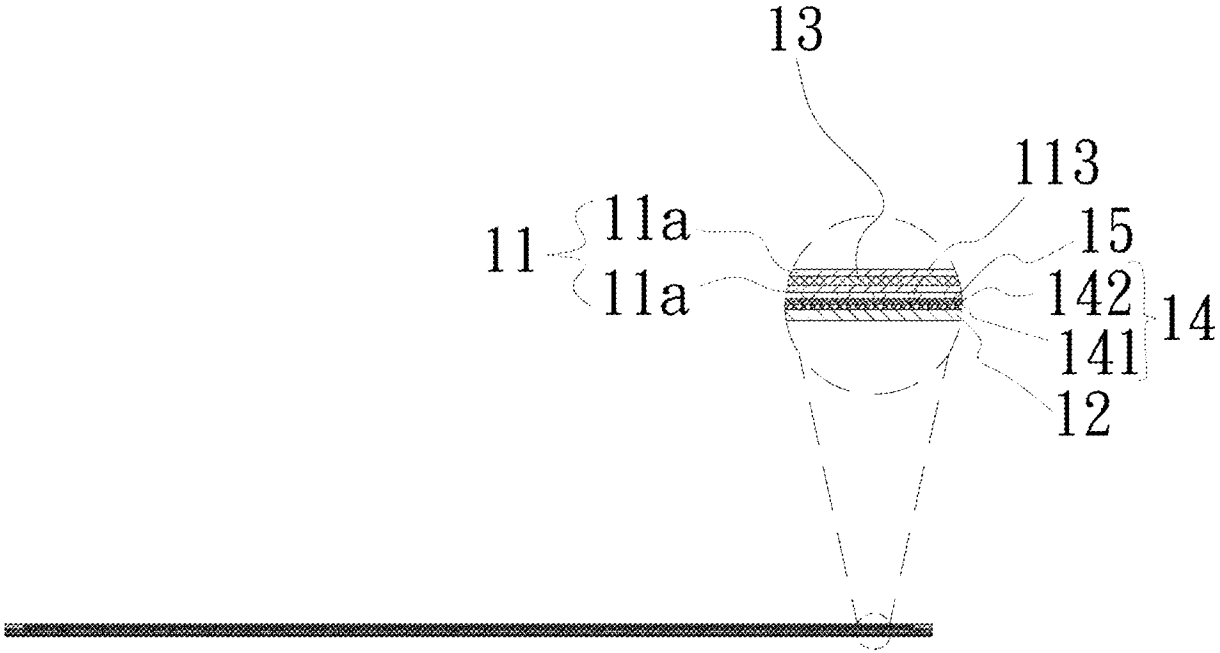
FIG. 3 is a sectional assembled view of a second embodiment of the thin-type two-phase fluid device of the present invention showing the multiple plate bodies forming the first plate.
Figure 4:
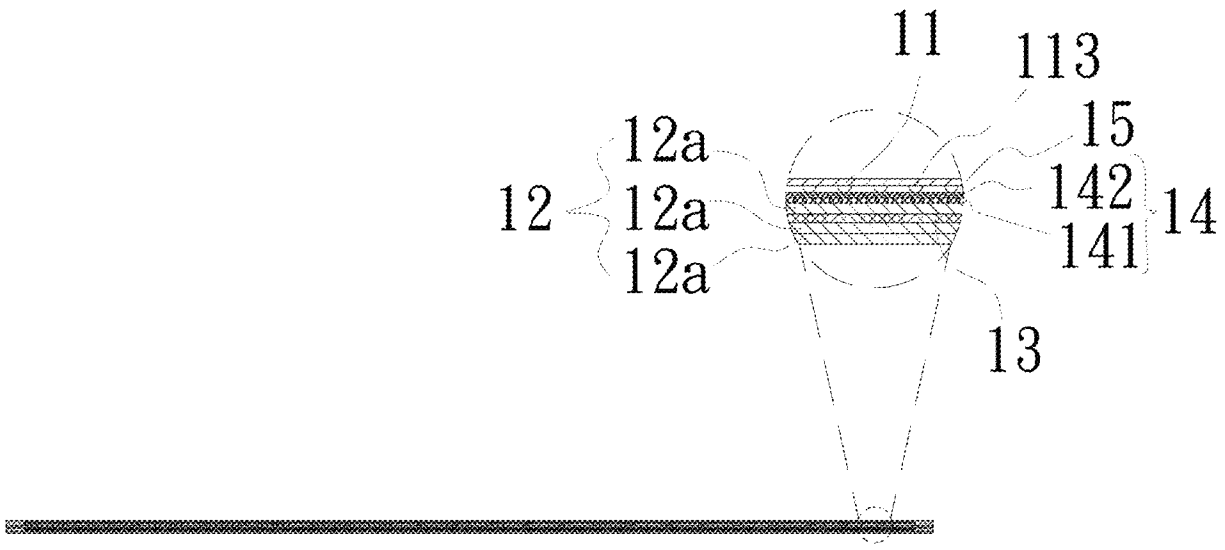
FIG. 4 is a sectional assembled view of a third embodiment of the thin-type two-phase fluid device of the present invention showing the multiple plate bodies forming the second plate.

In a second embodiment, the first plate body is composed of multiple plate bodies 11*a* laminated with each other, as shown in FIG. 3. The polymer layer is sandwiched between the plate bodies to form the first plate body. That is, the first plate body is composed of multiple plate bodies laminated with each other and the polymer layer is disposed between the plate bodies. The polymer layer is held by and laminated with the plate bodies and integrally sealed to form the first plate body. Alternatively, in a third embodiment, the second plate body, formed from multiple plate bodies 12*a* as shown in FIG. 4, is identical to the structure of the first plate body and the polymer layer is disposed inside the second plate body and integrally laminated therewith.

The bosses are recessed from the second face to the first face and raised from the first face. The bosses are selectively in contact with or not in contact with the nanometer capillary layer.

A hydrophilic layer is selectively disposed on the first face of the first plate body or one face of the second plate body opposite to the first face of the first plate body or the surface of the nanometer capillary layer.

Alternatively, a hydrophilic layer can be disposed on each of the first face of the first plate body, one face of the second plate body opposite to the first face of the first plate body and the surface of the nanometer capillary layer. In this embodiment, the hydrophilic layer is, but not limited to, disposed on any of the three.

The present invention mainly provides a thin-type two-phase fluid device, especially a vapor chamber or a flat-plate heat pipe. The various capillary structures employed by the conventional techniques are applied to the vapor chamber or flat-plate heat pipe under limitation. Therefore, the vapor chamber or flat-plate heat pipe can be hardly successfully thinned. Therefore, the present invention improves the shortcoming of the conventional vapor chamber and flat-plate heat pipe that in the thinning process, the capillary structure cannot be thinned. In the present invention, multiple kinds of powders with different sizes are mixed and then disposed on the thinned plate body by means of spraying, adhesion, staining, printing and static attraction. Accordingly, the thickness of the capillary structure is minified so as to achieve thinning effect. Also, the capillary structure can still keep the capillary attraction and the thin-type two-phase fluid device can be bent. Therefore, the capillary structure of porous powders with best capillary attraction is kept. In addition, in cooperation with the design of the polymer layer 13, the capillary structure can be thinned and bent without destroying the capillary attraction of the capillary structure. Therefore, the capillary structure has the properties of bendability and flexibility. Under such circumstance, the entire heat dissipation device can be greatly thinned and the total thickness of the heat dissipation device can be even equal to or smaller than 0.25 mm. The present invention improves the shortcoming of the conventional capillary structure that the capillary structure cannot be thinned. By means of the improved technical means and structure, the present invention can achieve the structure, which cannot be made and formed by the conventional technique.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A thin-type two-phase fluid device comprising:

a first plate body formed of multiple plate bodies laminated with each other and having a first face, a second face, and multiple bosses-disposed on the first face and raised therefrom;

a second plate body formed of multiple plate bodies laminated with each other and having a nanometer capillary layer on one face, the nanometer capillary layer being formed from a mixture of multiple kinds of powders with different sizes attached to a surface of the second plate body opposite to the first face of the first plate body; and a polymer layer selectively sandwiched between the multiple plate bodies of the first plate body or between the multiple plate bodies of the second plate body the total thickness of the thin-type two-phase fluid device being equal to or smaller than 0.25 mm.

2. The thin-type two-phase fluid device as claimed in claim 1, wherein the nanometer capillary layer has multiple first powders and multiple second powders, the diameter of the first powders being larger than the diameter of the second powders, the first and second powders being mixed and formed on one face of the second plate body opposite to the first plate body by means of sintering, adhesion, spraying or printing.

3. The thin-type two-phase fluid device as claimed in claim 1, wherein the polymer layer is selectively formed by means of painting, printing, or adhesion.

4. The thin-type two-phase fluid device as claimed in claim 1, wherein the first and second plate bodies are overlapped and mated with each other to define an airtight chamber, the nanometer capillary layer being disposed in the airtight chamber, a working liquid being filled in the airtight chamber.

* * * * *